US006431098B2

(12) United States Patent
Asazuma et al.

(10) Patent No.: US 6,431,098 B2
(45) Date of Patent: Aug. 13, 2002

(54) FABRIC PRESSER FOOT DEVICE OF SEWING MACHINE

(75) Inventors: Yoshiyuki Asazuma; Tohru Seiriki, both of Toyonaka (JP)

(73) Assignee: Yamato Sewing Machine Seizo Co., Ltd., Osaka-fu (JP)

( * ) Notice: Subject to any disclaimer, the term of this patent is extended or adjusted under 35 U.S.C. 154(b) by 0 days.

(21) Appl. No.: 09/867,078

(22) Filed: May 29, 2001

(51) Int. Cl.[7] ..... D05B 29/10
(52) U.S. Cl. ..... 112/235
(58) Field of Search ..... 112/235, 240, 112/323, 324, 322

(56) References Cited

U.S. PATENT DOCUMENTS 2,513,343 A * 7/1950 Maxson ..... 112/235
2,907,291 A * 10/1959 Schrader ..... 112/235 X
3,094,089 A * 6/1963 Shuman ..... 112/235
3,754,519 A * 8/1973 Howell ..... 112/235
4,010,701 A * 3/1977 Helfont ..... 112/235
5,335,612 A * 8/1994 Cizek et al. ..... 112/235

* cited by examiner

*Primary Examiner*—Ismael Izaquirre
(74) *Attorney, Agent, or Firm*—D. Peter Hochberg; Katherine R. Vieyra; William H. Holt

(57) ABSTRACT

A thick fabric of poor surface smoothness, such as a fabric for wet suit, can be fed reliably, smoothly and uniformly to perform sewing of excellent finish, without requiring any oil application to the fabric surface before sewing, by arranging a presser foot body, a small presser foot and a roller as follows. The presser foot body is fixedly supported to a lower end portion of a presser bar supported to a sewing arm part so that it is free to move vertically and reciprocally. The small presser foot resiliently pressing the fabric to the upper surface side of a throat plate is disposed on the downstream side than a needle location hole of the presser foot body in the sewing direction. The roller is disposed on the upstream side than the needle location hole in the sewing direction and is rotatable such that its contact portion with the fabric is successively changed with the fabric feed.

5 Claims, 4 Drawing Sheets

FABRIC PRESSER FOOT DEVICE OF SEWING MACHINE

BACKGROUND OF THE INVENTION

1. Field of the Invention

The present invention relates to a fabric presser foot device of a sewing machine and, more particularly, to a fabric presser foot device of a sewing machine used when a fabric having a relatively large thickness and poor surface smoothness, such as a fabric for wet suit of which surface is covered or coated with a waterproof rubber membrane, is sewed in the state that its end portions are adjoined or overlapped with each other.

2. Description of the Background Art

Such a type of fabric presser foot device has generally been constructed as follows. For the purpose that a fabric set on a throat plate is linearly and smoothly fed without causing any lateral deviation in the sewing direction, a fabric presser foot such as a plate spring of a length extending from the upstream position to the downstream position than a needle location in the sewing direction is disposed at a lower end portion of a presser bar allowing for the vertically reciprocal motion of this long fabric presser foot, in order to resiliently press the fabric portions at their locations corresponding to a pair of front and rear feed dogs disposed below the throat plate, to the upper surface of the throat plate, that is, the front and rear feed dogs.

In this conventional fabric presser foot device of a sewing machine comprising the fabric presser foot such as a plate spring having a long pressing surface along the sewing direction, when sewing a fabric having a high surface smoothness, e.g., a knit, because of the high smoothness between the pressing surface of the fabric presser foot and the surface of the fabric (i.e., a small frictional resistance), no problem occurs in the fabric feed. On the other hand, when sewing a fabric having poor surface smoothness, such as a fabric for wet suit of which surface is covered or coated with a waterproof rubber membrane, due to the poor smoothness between the pressing surface of the fabric presser foot and the surface of the fabric (i.e., a large frictional resistance), the brake is applied therebetween, thus making it impossible to feed the fabric. Even if possible, in this state it is liable to cause the disadvantages that the non-uniform and unstable feed may damage the fabric and deteriorate the finish.

To avoid the disadvantages in sewing a fabric having poor surface smoothness, e.g., the mentioned fabric for wet suit, there has conventionally been taken a means of applying oil, such as a lubricating oil, to the surface of the fabric before sewing, for the purpose of increasing the surface smoothness. This means, however, involves the oil application to the fabric and oil removing after sewing, which are not directly related to the sewing operation. Therefore, it is unavoidable that not only the efficiency of the overall sewing operation is lowered but also the sewing product is stained by the oil.

SUMMARY OF THE INVENTION

Accordingly, it is an object of the present invention to provide a fabric presser foot device of a sewing machine with which no lateral drift of a fabric is caused and, even in sewing a fabric having poor surface smoothness, the fabric can be fed reliably, smoothly and uniformly without requiring such an operation of applying oil to the fabric.

The above mentioned object is attained according to the present invention by a fabric presser foot device of a sewing machine for the type having a throat plate and a pair of front and rear feed dogs disposed below the throat plate to forcedly convey a fabric set on the throat plate in the sewing direction, wherein the improvement comprises: a presser foot body fixedly supported to a lower end portion of a presser bar supported to a sewing arm part so that it is movable vertically reciprocally, the presser foot body having a needle location through which a needle moves vertically; a fabric presser foot disposed on the downstream side than the needle location in the sewing direction to resiliently press the fabric to the upper surface side of the throat plate, the fabric presser foot being attached to the presser foot body; and a rolling body for feeding and guiding the fabric disposed on the upstream side than the needle location in the sewing direction, the rolling body being brought into contact with the upper surface of the fabric and being rotatably supported so that its contact portion is successively changed along with the fabric feed.

With this construction, the fabric set on the throat plate can be pressed to the upper surface of the throat plate by the fabric presser foot disposed on the downward side than the needle location in the sewing direction and the rolling body disposed on the upstream side than the needle location in the sewing direction, and the fabric is fed and guided linearly in the absence of any lateral drift by the forced feed force of the front and rear feed dogs. Further, since the rolling body of which contact portion with the upper surface of the fabric is successively changed with the fabric feed is employed as a pressing means on the upstream side in the sewing direction, even when sewing a fabric of extremely poor surface smoothness, such as a fabric for wet suit of which surface is covered or coated with a waterproof rubber membrane, the fabric can be fed and guided reliably, smoothly and in a stable uniform manner by minimizing the frictional resistance between the rolling body and the fabric surface, without requiring any oil application to the fabric surface before sewing and any oil removing after sewing. It is therefore avoidable that the fabric is damaged and the sewing finish is deteriorated.

A rolling body of the fabric presser foot device of the invention may be disposed at a sewing arm part, separately from the presser foot body to which the fabric presser foot is attached, so as to be movable vertically reciprocally. Alternatively, a rolling body may be supported to a support block coupled to the presser foot body, so that it can move vertically reciprocally in synchronism with the vertical reciprocal motion of the presser foot body. This construction can simplify the overall structure of the presser foot device and also reliably synchronize the timing of the vertical motions of the fabric presser foot and the rolling body.

As a rolling body of the fabric presser foot device, a roller or rotary belt may be used, and a roller is preferable in terms of structure.

Alternatively, the support block may be attached to the presser foot body so that it can vertically slide and be fixed thereto. By the vertical slide of the support block, the height of the rolling body is adjustable according to the thickness of the fabric. With this construction, according to the thickness of the fabric to be sewed, the height of the rolling body is adjusted to optimize the fabric pressing force. This enables to feed and guide the fabric reliably, smoothly and uniformly, irrespective of the thickness of the fabric.

Alternatively, the rolling body may be divided into two in the axis of rotation and a gap capable of absorbing a difference between the overlapped end portions of a fabric is formed between the opposed end surfaces of the divided rolling body. With this construction, when sewing a thick fabric having poor surface smoothness with its end portions overlapped with each other, a difference between the overlapped ends at which the thickness is locally increased than other portions can be absorbed by the gap. Even when such a thick fabric of poor surface smoothness is sewed with its end portions are overlapped with each other, a reliably smoothly uniform feed performance can be exhibited without excessively increasing the pressing force of the rolling body.

These and other objects, features, aspects and advantages of the present invention will become more apparent from the following detailed description of the present invention when taken in conjunction with the accompanying drawings.

DESCRIPTION OF THE PREFERRED EMBODIMENTS

Preferred embodiments of the invention will now be described based on the accompanying drawings.

Figure 1:
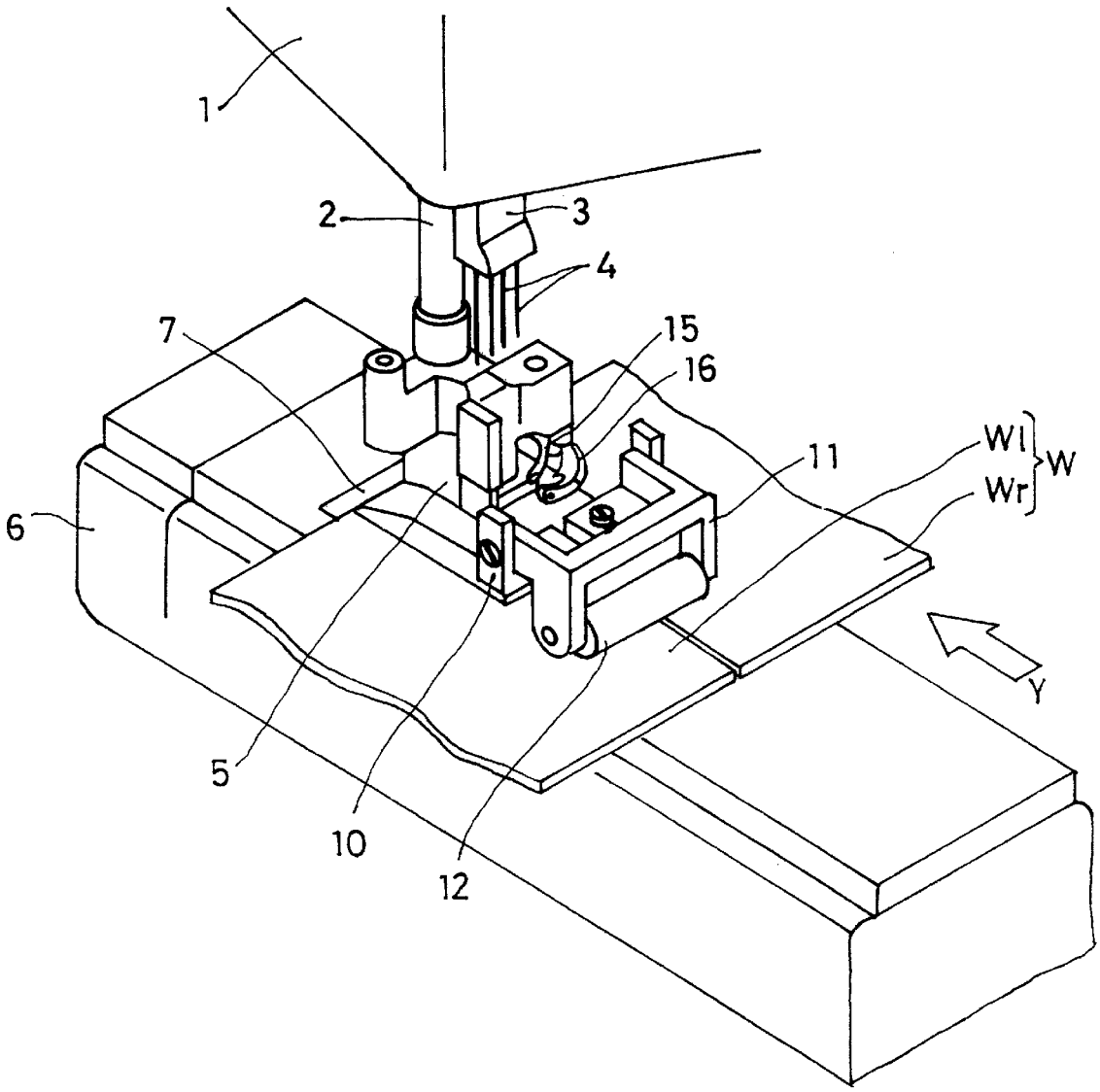
FIG. 1 is a perspective view of the vicinity of a needle location of an interlock stitch sewing machine to which a fabric presser foot device of the present invention is applied.

FIG. 1 is a perspective view of the vicinity of a needle location of an interlock stitch sewing machine to which the present invention is applied. Disposed at the end portions of a sewing arm part 1 are a needle bar (not sown) and a presser bar 2, which are arranged in front of and behind in a sewing direction Y and are vertically supported so as to be free to move vertically reciprocally. A plurality of needles 4 are attached via a pointer stop 3 to a lower end portion of the needle bar, and a presser foot body 5 is fixedly supported to a lower end portion of the presser bar 2.

Figure 3:
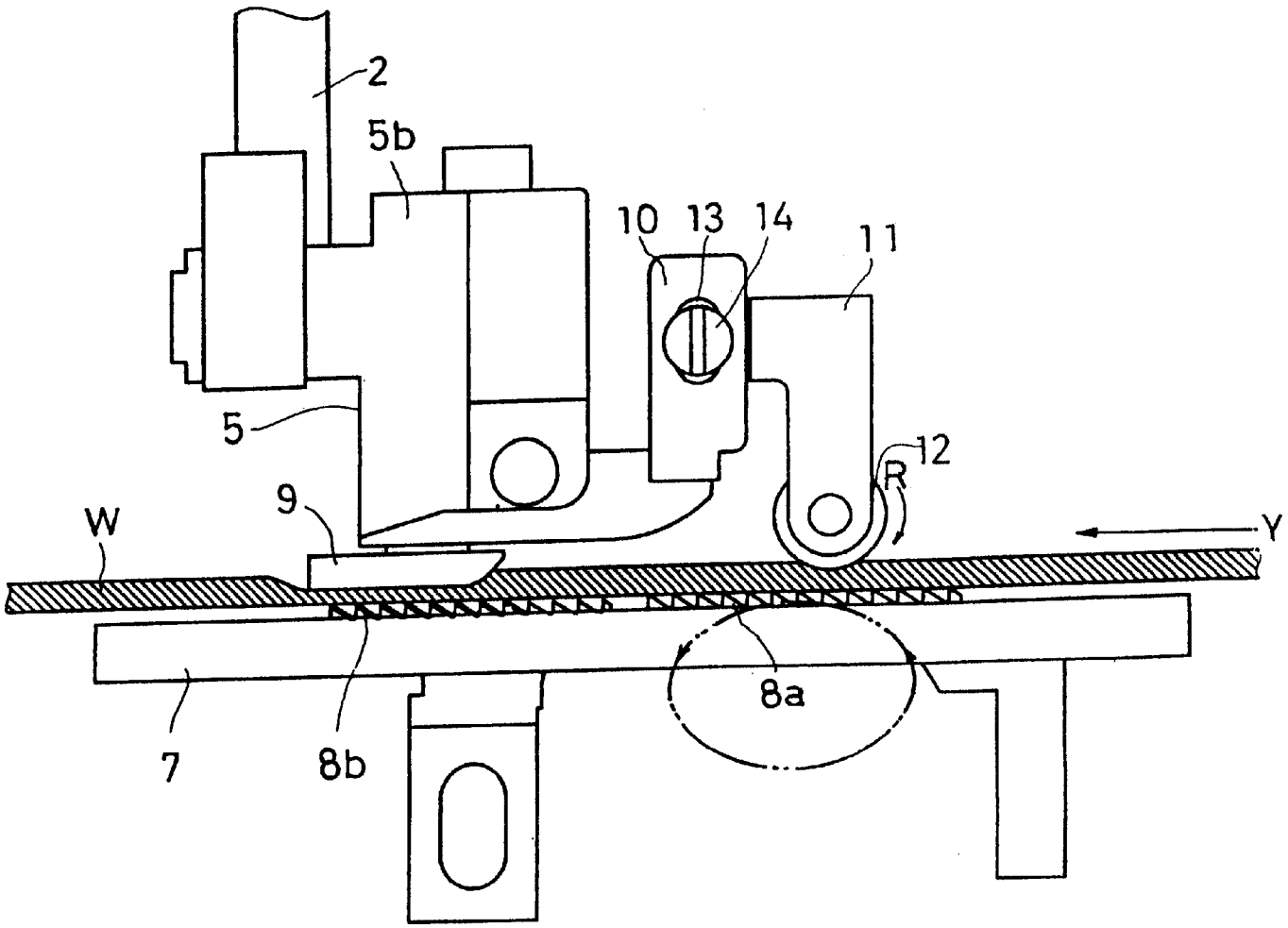
FIG. 3 is an enlarged side view of the important parts of the fabric presser foot device in the above sewing machine.

A stitch plate 7 is fixed to the upper surface of a slender cylindrical cylinder bed part 6 underlying the sewing arm part 1. Referring to FIG. 3, a pair of movable feed dogs made up of a front feed dog 8*a* and a rear feed dog 8*b* are disposed in the interior of the cylinder bed part 6 below the throat plate 7. The front and rear feed dogs 8*a* and 8*b* have such an ellipsoidal motion orbit as to project above the upper surface of the stitch plate 7 and forcedly convey a fabric W (composed of right and left fabrics Wr and Wl shown in FIG. 1) set on the throat plate 7 in the sewing direction Y. Besides, in the interior of the cylinder bed part 6 there are disposed components for sewing such as a looper and a feed dog operating mechanism (which are well known and its description and depiction are omitted).

Figure 2:
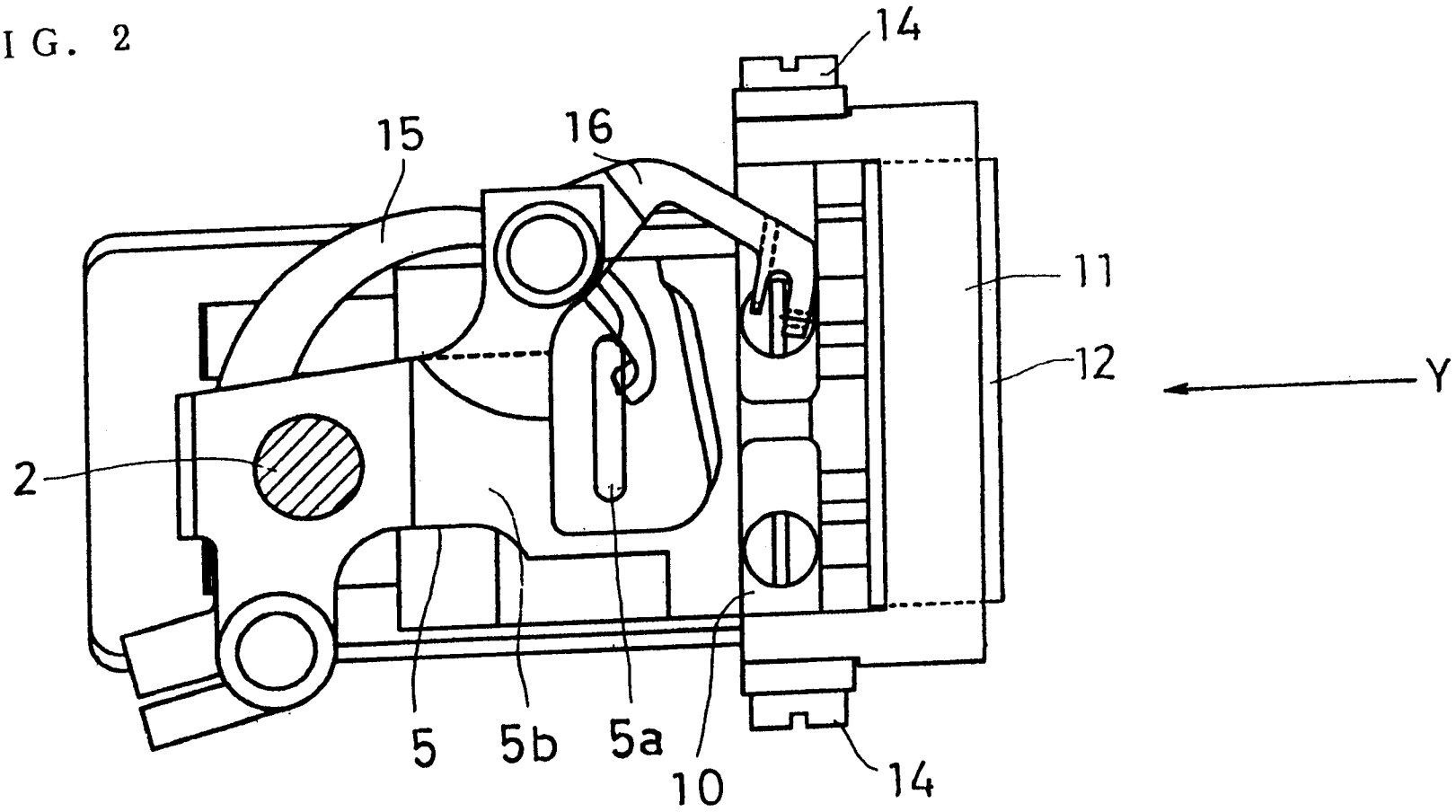
FIG. 2 is an enlarged plan view of important parts of the fabric presser foot device in the above sewing machine.

Referring to FIG. 2, a needle location hole (needle location portion) 5*a* through which the needles 4 move vertically is formed in the presser foot body 5, and a cylindrical portion 5*b*, the upper end of which is closed, is formed on a downstream side than the needle location hole 5*a* in the sewing direction Y. A fabric presser foot (hereinafter referred to as a "small presser foot") 9, which resiliently presses the fabric W (Wr, Wl) via a spring (not shown) to the upper surface side of the throat plate 7, namely to the rear feed dog 8*b* side, is engaged and supported to the inside of the cylindrical portion 5*b*.

A support block 11 having approximately a gate shape is coupled and fixed, via a coupling block 10, at a position on the upstream side than the needle location hole 5*a* of the presser foot body 5 in the sewing direction Y. A roller for fabric feed and guide (one example of the rolling body) 12 is supported to a lower end of the support block 11 so as to be rotatable around the horizontal axis. The roller 12 makes contact with the upper surface of the fabric W (Wr, Wl) on the upstream side than the needle location hole 5*a* in the sewing direction Y, and presses the portions of the fabric W to the front feed dog 8*a* side.

By pressing the portions of the fabric W (Wr, Wl) to the front feed dog 8*a* side the roller 12 rotates around the horizontal axis in the direction of arrow R, so that its contact portion is successively changed with the fabric feed of the front feed dog 8*a*. As shown in FIG. 3, the support block 11 is attached to the coupling block 10 via a long hole 13 and a fixing bolt 14, so that it can vertically slide and be fixed. Thereby, the height of the roller 12 is adjustable according to the thickness of the fabric W (Wr, Wl).

Referring again to FIGS. 1 and 2, a fancy thread hook 15 and a fancy thread carrier lever 16 for sewing a fancy thread to the upper surface at the location where the right and left fabrics Wr and Wl are sewed together, are attached to the presser foot body 5. The roller 12 is arranged on the upstream side than the fancy thread hook 15 and fancy thread carrier lever 16 in the sewing direction and at a location as close as possible to their motion orbits.

The fabric pressing operation of the fabric presser foot device thus constructed will next be described.

After the presser foot body 5 is elevated, the right and left fabrics Wr and Wl are set on the throat plate 7 in the state that their end portions are adjoined with each other, as shown in FIG. 1. The presser foot body 5 is then lowered and the sewing machine is operated to start sewing.

When the sewing operation is started, the fabrics W (Wr, Wl) set on the throat plate 7 is pressed at locations on its upstream side and its downstream side than the needle location hole 5*a* in the sewing direction Y, to the upper surface of the throat plate 7, namely to the front and rear feed dogs 8*a* and 8*b* sides, by the roller 12 and small presser foot 9. Upon receipt of the forced feed force of the front and rear feed dogs 8*a* and 8*b*, the fabric W is fed and guided linearly in the sewing direction Y in the absence of lateral drift, while the right and left fabrics Wr and Wl are sewed together and, at the same time, a fancy thread is sewed to the upper surface of the sewing locations by the operations of the fancy thread hook 15 and fancy thread carrier lever 16.

Since the roller 12 being free to rotate so that the contact portion with the upper surface of the fabric W is successively changed with the fabric feed is employed as a means for pressing the portions of the fabric W locating on the upstream side in the sewing direction Y, to the front feed dog 8*a* side, the frictional resistance between the roller 12 and the surface of the fabric W is considerably small even in sewing a fabric W having very poor surface smoothness, such as a fabric for wet suit of which surface is covered or coated with a waterproof rubber membrane. Therefore, without applying any oil to the fabric surface before sewing and removing the oil after sewing, the fabric W can be fed and guided via the front and rear feed dogs 8*a* and 8*b* reliably, smoothly and in a stable uniform manner by the cooperation of the small presser foot 9 and roller 12. This avoids the drawbacks that the fabric W is damaged and the sewing finish is deteriorated.

Particularly when an upper fancy thread is sewed to the upper surface of the sewing locations, the smoothness between the small presser foot 9 and the fabric W is increased (i.e., frictional resistance is reduced). Therefore, even for the fabric W having poor surface smoothness, e.g., the fabric for wet suit, a further smooth feed performance is obtainable.

In addition, by adjusting the height of the roller 12 according to the thickness of the fabric W, the fabric W can be fed and guided reliably, smoothly and uniformly irrespective of the thickness of the fabric W, as described above.

Figure 4:
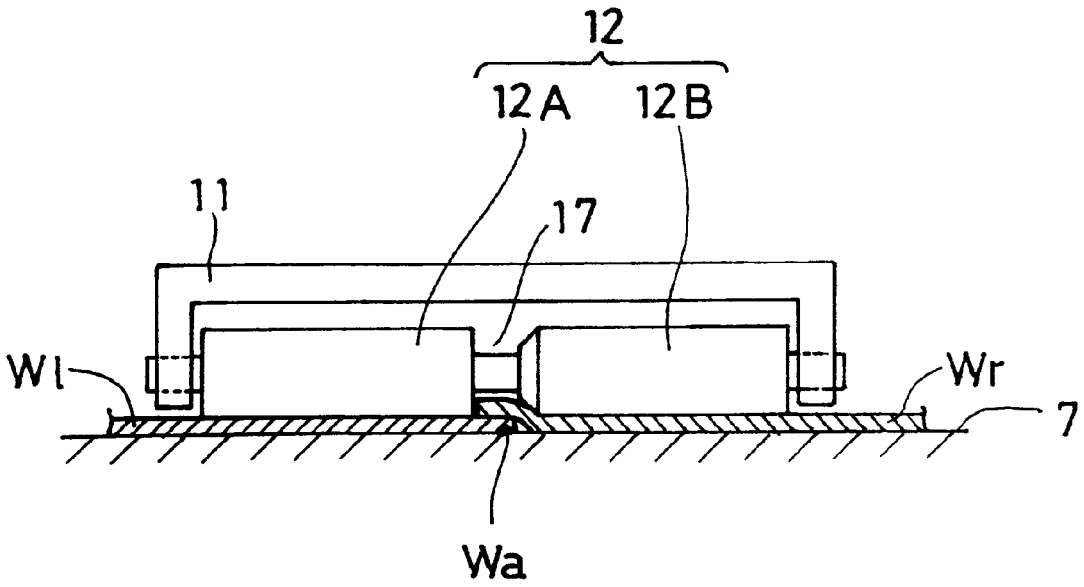
FIG. 4 is an enlarged front view of important parts in a preferred embodiment of the fabric presser foot device of the present invention.

In the foregoing preferred embodiment, description has been proceeded to the case of sewing the right and left fabrics Wr and Wl with their end portions adjoined with each other. When the right and left fabrics Wr and Wl are sewed with their end portions stacked one upon another, the roller 12 preferably has the construction shown in FIG. 4. That is, the roller 12 is divided into two in the direction of axis of rotation, and a gap 17 capable of absorbing a difference in a stacked end portion Wa of the right and left fabrics Wr and Wl is formed between the opposed end surfaces of the divided cylindrical rollers 12A and 12B.

Thanks to the divided roller 12, when thick right and left fabrics Wr and Wl having poor surface smoothness are sewed together in the state that their end portions are stacked one on another, a difference between the stacked end portion Wa at which the thickness is locally increased than other portions can be absorbed by the gap 17. Therefore, even when the end portions of a thick fabric having poor surface smoothness are sewed together, there is no possibility that the forced pressing force of the roller 12 is excessively and locally increased, thereby providing the sewing of excellent finish because of the reliably smooth and uniform feed performance.

Although in the foregoing preferred embodiments, the roller 12 having a simple structure is employed as a rolling body, the same feed and guide performance is obtainable by employing a rotary belt.

While the invention has been shown and described in detail, the foregoing description is in all aspects illustrative and not restrictive. It is therefore understood that numerous modifications and variations can be devised without departing from the scope of the invention.

What is claimed is:

1. A fabric presser foot device of a sewing machine for the type having a throat plate and a pair of front and rear feed dogs disposed below the throat plate to forcedly convey a fabric set on the throat plate in the sewing direction, the front and rear feed dogs being disposed separately on a downstream side and an upstream side in the sewing direction from a needle location, wherein the improvement comprises:

a presser foot body fixedly supported on a lower end portion of a presser bar supported on a sewing arm part so that it is movable vertically reciprocally, the presser foot body having the needle location through which a needle moves vertically;

a fabric presser foot resiliently pressing the fabric to the upper surface side of the throat plate which is disposed at a location corresponding to the front feed dog on the downstream side in the sewing direction from the needle location; and a rolling body conveying and guiding the fabric which is disposed at a location corresponding to the rear feed dog on the upstream side in the sewing direction from the needle location, the rolling body having a contact portion with the upper surface of the fabric and being rotated such that the contact portion is successively changed as the fabric is conveyed, the rolling body being rotatably supported on a support block attached to the presser foot body, said support block being free to vertically slide and be fixed, allowing for adjustment of the height of the rolling body independently of the fabric presser foot.

2. The fabric presser foot device according to claim 1 wherein the rolling body is a roller or rotary belt.

3. The fabric presser foot device according to claim 1 wherein the rolling body is divided into two in the direction of the axis of rotation and a gap capable of absorbing a difference between the stacked end portions of the fabric is formed between the opposed end surfaces of the divided rolling body.

4. The fabric presser foot device according to claim 1 wherein the rolling body is divided into two in the direction of the axis of rotation and a gap capable of absorbing a difference between the stacked end portions of the fabric is formed between the opposed end surfaces of the divided rolling body.

5. The fabric presser foot device according to claim 1 wherein the rolling body is divided into two in the direction of the axis of rotation and a gap capable of absorbing a difference between the stacked end portions of the fabric is formed between the opposed end surfaces of the divided rolling body.

* * * * *